US006076711A

United States Patent [19]

McGuffey

[11] Patent Number: 6,076,711

[45] Date of Patent: Jun. 20, 2000

[54] HIGH FLOW PNEUMATIC ADHESIVE APPLICATOR VALVE

[75] Inventor: Grant McGuffey, Springfield, Tenn.

[73] Assignee: Illinois Tool Works Inc., Glenview, Ill.

[21] Appl. No.: 09/271,872

[22] Filed: Mar. 18, 1999

[51] Int. Cl.[7] ..... B67D 3/00

[52] U.S. Cl. ..... 222/504; 222/559

[58] Field of Search ..... 222/504, 518; 91/520, 533

[56] References Cited

U.S. PATENT DOCUMENTS

| | | | |
|---|---|---|---|
| 3,398,647 | 8/1968 | Baltus et al. | 91/533 |
| 3,402,778 | 9/1968 | Carter et al. | 91/533 |
| 3,485,141 | 12/1969 | Ott et al. | 91/533 |
| 3,554,088 | 1/1971 | Bruyn | 91/533 |
| 3,580,435 | 5/1971 | Bertilsson | 222/504 |
| 3,690,518 | 9/1972 | Baker et al. | 222/504 |
| 3,752,161 | 8/1973 | Bent | 91/533 |
| 4,852,773 | 8/1989 | Standlick et al. | 222/504 |
| 4,988,015 | 1/1991 | Price | 222/504 |
| 5,247,870 | 9/1993 | Brasca et al. | 91/520 |
| 5,467,899 | 11/1995 | Millaer | 222/504 |
| 5,887,768 | 3/1999 | Price et al. | 222/504 |
| 5,924,607 | 7/1999 | Yamada et al. | 222/504 |
| 5,934,521 | 8/1999 | Yamada et al. | 222/504 |

*Primary Examiner*—Lesley D. Morris
*Assistant Examiner*—Christopher S. Kim
*Attorney, Agent, or Firm*—Schwartz & Weinrieb

[57] ABSTRACT

A high-flow, pneumatically-controlled hot melt adhesive applicator valve assembly comprises a housing which includes a lower module body within which a die orifice is defined. A ball valve member is operatively associated with the die orifice, and a hot melt adhesive charge passageway is provided within the module body so as to fluidically conduct the hot melt adhesive to the die orifice. A middle-air cylinder is disposed atop the module body and defines a first cylinder chamber therein, and an upper-air cylinder is disposed atop the middle-air cylinder and defines a second cylinder chamber therein. The valve member is fixedly mounted upon the lower end of a piston rod, and first and second pistons are fixedly mounted upon axially central and upper end portions of the piston rod so as to define with the piston rod and the first and second cylinder chambers a dual-piston multiplier assembly. OPEN and CLOSE air passageways are fludically connected to the cylinder chambers so as to actuate the dual-piston multiplier assembly vertically upwardly or downwardly so as to move the valve member accordingly. The middle-air cylinder includes an internal OPEN air passageway such that OPEN air is simultaneously fludically connected to the first and second cylinder chambers so as to simultaneously actuate the first and second pistons of the dual-piston multiplier assembly.

20 Claims, 2 Drawing Sheets

PROR ART

HIGH FLOW PNEUMATIC ADHESIVE APPLICATOR VALVE

FIELD OF THE INVENTION

The present invention relates generally to pneumatically-activated control valves, and more particularly to a new and improved pneumatically-activated control valve for use in connection with the controlled discharge of hot melt adhesive materials to an applicator device or nozzle.

BACKGROUND OF THE INVENTION

Pneumatically-activated control valves are of course well-known in the art, and such valves have also been known in the art for their use in connection with the controlled discharge of various materials, including, for example, the controlled discharge of hot melt adhesive materials to an applicator device or nozzle. An exemplary, well-known pneumatically-activated control valve, having the product designation MR1300 and manufactured by ITW DYNATEC of Hendersonville, Tenn., is illustrated in FIG. 1. For background purposes, the illustrated valve assembly will not be described in exhaustive detail, but will only be described in sufficient detail in order to provide a sufficient understanding of the major components of the valve assembly and the operation thereof.

More particularly, the valve assembly is generally indicated by the reference character 10 and is seen to comprise a module body 12 which has mounted within the lower end portion thereof a nozzle adapter and valve seat assembly 14. A piston assembly, comprising a piston valve stem 16, which passes through a seal cartridge 18 such that the lower end of the piston valve stem 16 operatively cooperates with the valve seat of the assembly 14 so as to selectively control the discharge of adhesive material from the valve assembly 10 during adhesive application cycles, and a piston head 20 swaged to the upper end of the piston valve stem 16, is vertically movable within the valve assembly 10 so as to achieve the OPEN and CLOSED states of the valve assembly 10 as desired for adhesive application cycles.

An air cylinder 22 is bolted to the upper end of the module body 12 by means of a plurality of threaded bolt fasteners 24, and an O-ring 26 is mounted within a sidewall portion of air cylinder 22 so as to be disposed around an air inlet passage, not shown, through which pneumatic air is transmitted so as to act upon the upper surface of piston head 20 when it is desired to move the piston assembly vertically downwardly in order to move the lower end of the piston valve stem 16 from its OPENED position to its CLOSED position with respect to the valve seat of the nozzle adapter and valve seat assembly 14 so as to terminate the discharge of adhesive material from the valve assembly 10. A stop member 28 is coaxially mounted within the upper end of the air cylinder 22, and secured therein by means of a hex nut 30, so as to limit the upward movement of the piston assembly, and a pair of inner and outer coil springs 32,34 are respectively disposed about the lower end of the stop member 28 and engage the upper surface of the piston head 20 so as to tend to bias the piston assembly downwardly whereby the piston valve stem 16 is effectively biased toward its CLOSED position.

The upper end of the module body 12 is provided with a recessed or counterbored seat 36 and an axial passageway 38 for accommodating the seal cartridge 18, a seal cartridge gasket being illustrated at 40. Another O-ring member 42 is adapted to be mounted upon an upper sidewall portion of the module body 12 so as to be disposed around an air inlet passage, not shown, through which pneumatic air is transmitted so as to act upon the undersurface of piston head 20 and thereby cause vertically upward movement of the piston assembly, and the consequent lifting of the lower end portion of the piston valve stem 16 with respect to the valve seat of the nozzle adapter and valve seat assembly 14, from its CLOSED position to its OPENED position, when it is desired to discharge adhesive material from the valve assembly 10. A third O-ring member 44 is adapted to be mounted upon a lower sidewall portion of the module body 12 so as to be disposed around an adhesive material inlet passage, also not shown, through which the supply of adhesive material is transmitted to the valve assembly 10.

While the aforenoted valve assembly 10 is of course quite satisfactory from an operational point of view, and has enjoyed and exhibited substantial commercial success, there are manufacturing processes and production assembly lines which utilize adhesive material valve applicators or assemblies similar to the valve assembly 10 but which require an adhesive material production output, discharge, or flow-through, per unit of time, which is greater than that able to be produced by means of a valve assembly such as the valve assembly 10 illustrated in FIG. 1 or similar thereto.

Accordingly, in order to achieve such a desired increased or enhanced adhesive material output, several options are possible and have been suggested, however, for one or more reasons, none of such options have proven or seem to be viable. For example, a first proposed option would be to utilize a larger valve assembly, however, larger valve assemblies are slower in operation thereby presenting problems in connection with the satisfaction of production line requirements, and in addition, the larger valve assembly, by definition, as a result of being larger, would not in effect be able to fit or be accommodated within the footprint of the existing valve assemblies whereby the newer valve assemblies would not be able to be retrofitted upon existing valve heads or modules.

A second alternatively proposed option would be to utilize a larger number of valve assemblies or modules in order to increase the adhesive material output as required, however, hot melt adhesive valve assemblies or modules require a predetermined amount of periodic maintenance. It is therefore desirable from a production point of view, as well as from a cost-effective point of view, to operationally limit the number of valve assemblies or modules in order to accordingly limit the amount of maintenance required in connection with the serviceability of the various valve assemblies or modules comprising a particular production line or arrangement, and the costs involved in maintaining the production line or arrangement in service without significant downtime.

A need therefore exists in the art for a new and improved high-flow pneumatically-controlled, hot melt adhesive applicator valve assembly which is able to discharge or dispense substantially large quantities of hot melt adhesive material, which exhibits relatively high-speed OPEN and CLOSE operational cycles so as to accurately achieve the discharge or dispensing operations as desired and when required despite the enhanced amount of hot melt adhesive material being discharged or dispensed, and which is substantially the same size as the known or prior art valve assemblies such that the new and improved high-flow pneumatically-controlled, hot melt adhesive applicator valve assemblies have substantially the same footprints as those of the known or prior art valve assemblies whereby the new and improved high-flow pneumatically-controlled, hot melt adhesive applicator valve assemblies can be retrofitted upon existing pneumatically-controlled, hot melt adhesive applicator valve assembly equipment.

OBJECTS OF THE INVENTION

Accordingly, it is an object of the present invention to provide a new and improved high-flow, pneumatically-controlled, hot melt adhesive applicator valve assembly.

Another object of the present invention is to provide a new and improved high-flow, pneumatically-controlled, hot melt adhesive applicator valve assembly which overcomes the various drawbacks and disadvantages of prior art pneumatically-controlled, hot melt adhesive applicator valve assemblies.

An additional object of the present invention is to provide a new and improved high-flow, pneumatically-controlled, hot melt adhesive applicator valve assembly which enhances the output production of the valve with respect to existing pneumatically-controlled hot melt adhesive valves, is of the same size as existing pneumatically-controlled hot melt adhesive valves, and still further, is able to operate with sufficiently high speed parameters as required.

A further object of the present invention is to provide a new and improved high-flow, pneumatically-controlled, hot melt adhesive applicator valve which is relatively simple in construction and relatively inexpensive to manufacture.

SUMMARY OF THE INVENTION

The foregoing and other objectives are achieved in accordance with the teachings and principles of the present invention through the provision of a new and improved high-flow pneumatically-controlled hot melt adhesive applicator valve assembly which comprises an enlarged hot melt adhesive material dispensing or discharge orifice, a piston assembly comprising a plurality of vertically aligned piston stems fixedly connected together, a ball valve member fixedly mounted upon the lower end of the lower one of the piston stems and operatively associated with an arcuately-configured valve seat, and a piston multiplier assembly comprising a plurality of pistons respectively operatively associated with the plurality of piston stems so as to reciprocally drive the piston assembly, and the ball valve member fixedly mounted upon the lower end of the lower one of the piston stems, through vertical movements which enable the ball valve member to OPEN and CLOSE the valve assembly discharge or dispensing orifice. A mid-air cylinder housing is disposed atop the valve or module body so as to accommodate the lower one of the two pistons, and in addition, the mid-air cylinder provides for the routing of OPEN air to the upper one of the two pistons which is disposed within an upper cylinder housing disposed atop the mid-air cylinder housing.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
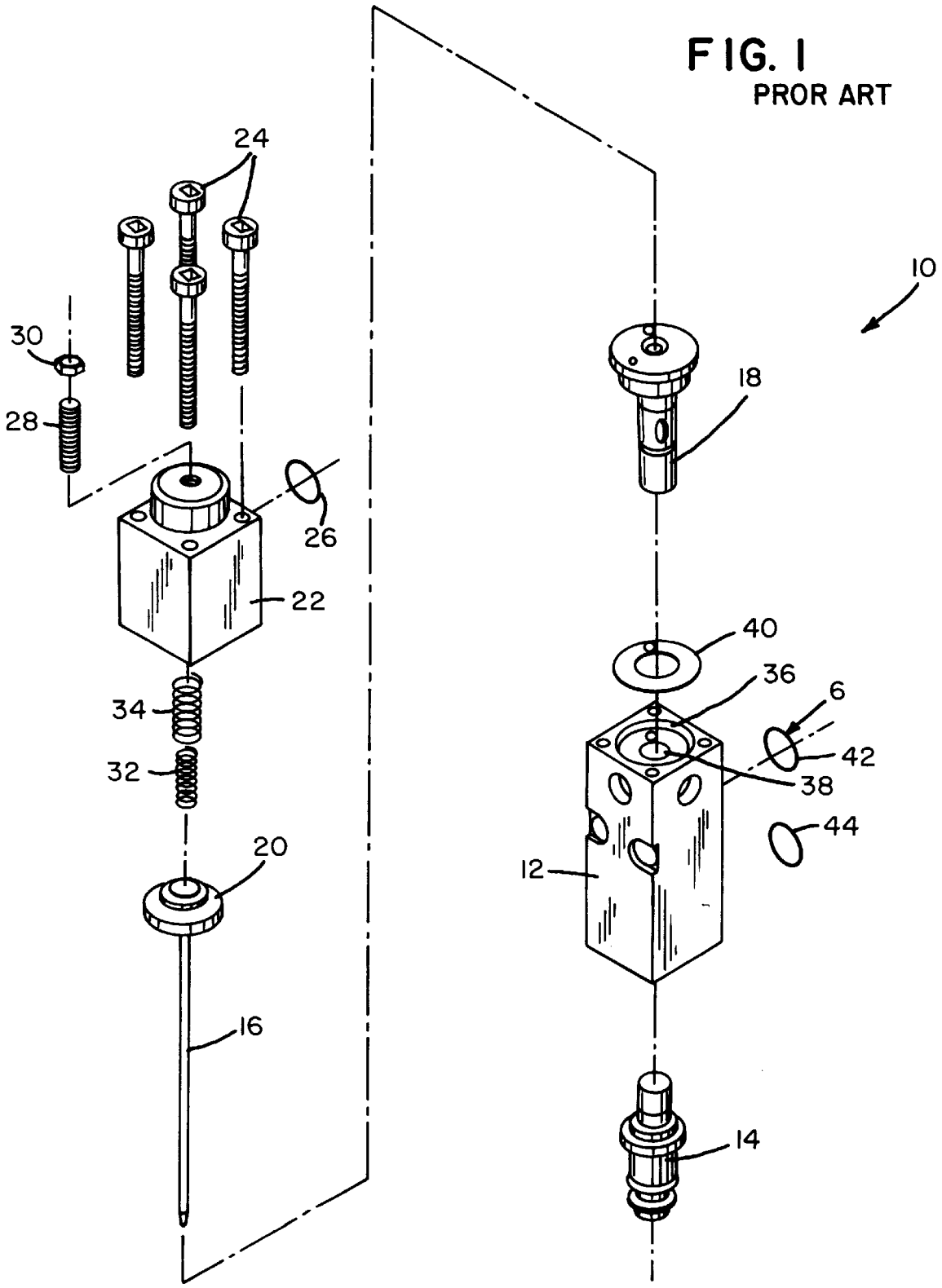
FIG. 1 is an exploded perspective view of a PRIOR ART pneumatically-controlled, hot melt adhesive applicator valve assembly showing the primary component parts thereof.
Figure 2:
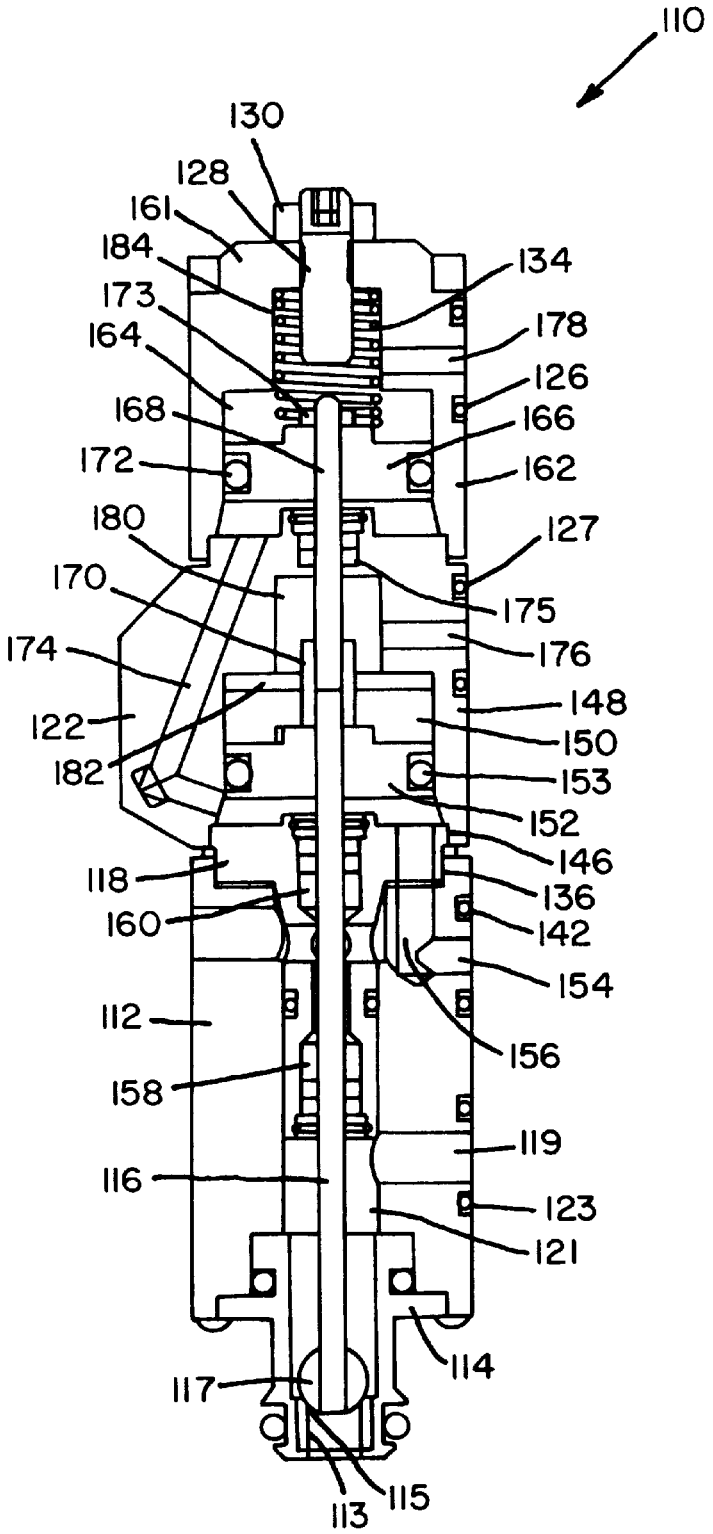
FIG. 2 is a cross-sectional view of the new and improved high-flow pneumatically-controlled, hot melt adhesive applicator valve assembly constructed in accordance with the teachings and principles of the present invention and disclosing the component parts thereof.

Referring now to the drawings, and more particularly to FIG. 2 thereof, the new and improved high-flow, pneumatically controlled, hot melt adhesive applicator valve assembly is disclosed and is generally indicated by the reference character 110. It is to be initially noted that component parts of the new and improved high-flow, pneumatically controlled, hot melt adhesive applicator valve assembly 110, constructed in accordance with the teachings and principles of the present invention and disclosed in FIG. 2, which are similar to those component parts of the PRIOR ART pneumatically controlled, hot melt adhesive applicator valve assembly 10 disclosed in FIG. 1, will be designated by reference characters similar to those used in connection with the PRIOR ART pneumatically controlled, hot melt adhesive applicator valve assembly 10 disclosed in FIG. 1 except that that reference characters used in connection with the high-flow, pneumatically controlled, hot melt adhesive applicator valve assembly 110 of the present invention will be within the 100 series.

Referring then more particularly to FIG. 2, the new and improved high-flow, pneumatically-controlled, hot melt adhesive applicator valve assembly 110 constructed in accordance with the teachings and principles of the present invention is seen to comprise a valve or module body 112 within which there is mounted a die member 114. The die member 114, in turn, comprises a die orifice 113 from which adhesive material is discharged or dispensed, and the die orifice 113 has an annular valve seat 115 integrally formed at the upper end thereof. The annular valve seat 115 has an arcuate or hemispherical configuration so as to be adapted to seat a ball valve member 117 which is soldered upon the lower end of a first, lower piston stem 116. The valve or module body 112 is provided with a first radially extending passageway 119, at an axial position which is located within a substantially lower, central portion of the valve or module body 112, so as to permit hot melt adhesive material to be conducted into the valve assembly 110. An axially extending passageway 121 fluidically interconnects the radially extending passageway 119 to the die orifice 113 so as to conduct the hot melt adhesive material to the die orifice 113 when the same is to be discharged from the valve assembly 110. An O-ring sealing member 123 annularly surrounds adhesive intake charge passageway 119.

The upper end of the valve or module body 112 is provided with a counterbored recessed portion 136, and a seal cartridge assembly 118 is adapted to have its lower end portion disposed within the counterbored recessed portion 136 of the valve or module body 112. A middle air cylinder housing 122 is adapted to be disposed atop the lower valve or module body 112, and it is seen that the lower end of the middle air cylinder housing 122 is provided with a counterbored recessed portion 146 so as to accommodate the upper end of the seal cartridge assembly 118 whereby the seal cartridge assembly 118 in effect sealingly bridges the lower valve or module body 112 and the middle air cylinder housing 122. The middle air cylinder housing 122 is seen to further comprise a first, lower cylinder 148 within which is defined a first, lower cylinder chamber 150, and a first, lower piston 152 is disposed within the first, lower cylinder chamber 150 so as to undergo reciprocal vertical movement therewithin. The first, lower piston 152 is internally threaded so as to be threadedly secured upon the upper end of the first, lower piston stem or rod 116.

The lower valve or module body 112 is seen to further comprise a second, radially extending passageway 154 defined at an axial position which is located adjacent to the upper end of the lower valve or module body 112, and an axially extending passageway 156 extends axially upwardly through the upper end of the lower valve or module body 112 and through the seal cartridge assembly 118. Second, radially extending passageway 154 is provided for introducing OPEN air into the valve assembly 110, and consequently, axially extending passageway 156 fluidically interconnects second, radially extending passageway 154 to the lower end portion of the first, lower cylinder chamber 150 so as to permit OPEN air to impinge upon the lower or undersurface of first, lower piston 152 when it is desired to lift ball valve member 117 from its valve seat 115. An O-ring sealing member 142 annularly surrounds second, radially extending passageway 154. In addition, the seal cartridge assembly 118 further comprises a first, lower seal member 158 for sealing the first, lower piston stem or rod 116 with respect to hot melt adhesive material flowing into axial passageway 121 from radial intake charge passageway 119, and a second, upper seal member 160 for sealing the first, lower piston stem or rod 116 with respect to OPEN air flowing into the lower end portion of the first, lower cylinder chamber 150, defined between the seal cartridge assembly 118 and the first, lower piston 152, from axial passageway 156. The first, lower piston 152 is also provided with an annular O-ring sealing member 153 for sealing the first, lower piston 152 with respect to the interior wall surface portions of the first, lower cylinder 148.

Disposed atop the middle air cylinder housing 122, there is provided an upper air cylinder housing 161 within the lower portion of which there is defined a second, upper cylinder 162. The second, upper cylinder 162 has a second, upper cylinder chamber 164 defined therein, and a second, upper piston 166 is disposed within the second, upper cylinder chamber 164. A second, upper piston rod or stem 168 is coaxially disposed with respect to first, lower piston rod or stem 116 and is fixedly connected to first, lower piston rod or stem 116 by means of a coupling nut 170. In a manner similar to first, lower piston 152 and first, lower piston rod or stem 116, second, upper piston 166 is internally threaded so as to be threadedly mounted upon the upper end of second, upper piston rod or stem 168. Second, upper piston 166 is adapted to be reciprocally movable in vertically upward and downward directions within the second, upper cylinder chamber 164, and in order to seal the second, upper piston 166 with respect to the interior wall surface portions of second, upper cylinder 162, second, upper piston 166 is provided with an annular O-ring sealing member 172. In order to fixedly retain second, upper piston 166 at its axial threaded position upon the upper end of the second, upper piston rod or stem 168, a nut member 173 is threadedly secured upon the upper threaded end of the second, upper piston rod or stem 168.

In order to provide for the vertically reciprocal upward movements of the second, upper piston 166, with respect to second, upper cylinder chamber 164, and in conjunction with the vertically reciprocal, upward movements of the first, lower piston 152 with respect to first, lower cylinder chamber 150, middle air cylinder 122 is further provided with an internal OPEN air passageway 174 which fluidically interconnects the lower end portion of first, lower cylinder chamber 150 with the lower end portion of second, upper cylinder chamber 164. In this manner, when OPEN air is introduced into the valve assembly 110 through means of radial passageway 154 and axial passageway 156, OPEN air is conducted from the lower end portion of first, lower cylinder chamber 150 and into internal passageway 174 whereby the OPEN air is introduced into the lower end portion of second, upper cylinder chamber 164 so as to be able to impinge upon the lower or undersurface portion of the second, upper piston 166.

Accordingly, upper and lower pistons 166 and 152, along with upper and lower piston stems or rods 168 and 116, which comprise a multiple piston multiplier assembly, are able to be moved vertically upward in a synchronized manner with respect to each other so as to operate together in rapidly moving ball valve member 117 vertically upwardly and away from its valve seat 115 in order to permit a predeterminedly controlled amount of hot melt adhesive material to be discharged from applicator die orifice 113. It is also noted that a stem seal cartridge or assembly 175 is provided upon a substantially axially central portion of the second, upper piston stem or rod 168 so as to seal the same with respect to the OPEN air conducted into the lower end portion of the second, upper cylinder chamber 164 from the internal OPEN air passageway 174.

In a manner similar to that previously described in connection with the provision of OPEN air to the multiple piston multiplier assembly, and in order to provide for the simultaneous or synchronized vertically reciprocal downward movements of both the first, lower and second, upper pistons 152 and 166 with respect to first, lower and second, upper cylinder chambers 150 and 164, along with first, lower and second, upper piston rods or stems 116 and 168, so as to rapidly move ball valve member 117 in a vertically downward direction and thereby seat the ball valve member 117 upon its valve seat 115 whereby the controlled discharge or deposit of the hot melt adhesive material from die orifice 113 is effectively blocked or terminated, the middle air cylinder 122 is provided with a radially extending CLOSE air passageway 176, and upper air cylinder 161 is similarly provided with a radially extending CLOSE air passageway 178. Passageway 176 is fluidically connected to an internal bore or chamber 180 defined or provided within the middle air cylinder housing 122, and internal bore or chamber 180 is fluidically connected to cylinder chamber 150 such that CLOSE air transmitted through CLOSE air passageway 176 impinges upon the upper surface of first, lower piston 152. A support member 182, for engaging coupling nut 170 and preventing rotation of the same while permitting axial movement thereof along with the piston stems or rods 116 and 168, is disposed within the upper end of cylinder chamber 150, and it is noted that support member 182 is of such structure as to permit the CLOSE air from internal bore or chamber 180 to pass therethrough and into cylinder chamber 150 whereupon the same can impinge upon the upper surface of first, lower piston 152.

In a similar manner, upper air cylinder housing 161 is provided with an internal bore or chamber 184, and the latter bore or chamber 184 is fluidically connected to the CLOSE air passageway 178 as well as to the upper end of the second, upper cylinder chamber 164. Accordingly, CLOSE air transmitted through CLOSE air passageway 178 is able to impinge upon the upper surface of second, upper piston 166 whereby the latter piston 166 together with first, lower piston 152 serve to move the ball valve member 117 vertically downwardly in order to seat the ball valve member 117 upon its valve seat 115. An annular O-ring sealing member 126 is operatively associated with the CLOSE air passageway 178, and an annular O-ring sealing member 127 is operatively associated with the CLOSE air passageway 176.

It is further noted that a coil spring 134 is disposed within the internal bore or chamber 184 such that the upper end of spring 134 is engaged with the upper end of chamber or bore 184 while the lower end of spring 134 is seated atop the second, upper piston 166. In this manner, the coil spring 134 serves to bias the multiple piston multiplier assembly downwardly so as to ensure proper seating of the ball valve member 117 upon its valve seat 115 should, for example, a failure be experienced in the CLOSE air transmission portion or routing section of the system. A stop member 128 is also mounted within the upper end of the upper air cylinder housing 161 such that the lower end of the stop member 128 projects into the internal bore or chamber 184, and a nut member 130 is engaged with the stop member 128 so as to retain the lower end portion of the stop member 128 at a predetermined axial position within the bore or chamber 184. In this manner, the lower end portion of the stop member 128 is disposed at a predetermined position with respect to the upper end of the second, upper piston rod or stem 168 so as to limit upward axial movement of the multiple piston multiplier assembly when OPEN air impinges thereon.

Thus, it may be seen that in accordance with the principles and teachings of the present invention, a new and improved high-flow, pneumatically-controlled, hot melt adhesive applicator valve assembly 110 has been disclosed wherein as a result of the inclusion, within the structural arrangement thereof, of the middle air cylinder housing 122, the first, lower piston 152, the first, lower piston rod or stem 116, and the internal OPEN air passageway 174, in addition to, or in conjunction with, the provision of the second, upper piston 166 disposed within the upper air cylinder housing 161, and the second, upper piston rod or stem 168, a multiple or dual-piston multiplier has been effectively integrally incorporated or provided within the valve assembly 110 whereby enhanced operational speed of the valve assembly 110, during both its OPEN and CLOSE operational phases or stages, has been able to be achieved so as to in turn provide the predetermined controlled and enhanced discharge or deposit of the hot melt adhesive material from the die orifice 113 as determined or controlled by means of the ball valve member 117. It is to be noted that the foregoing has also been achieved in conjunction with a single enlarged valve or die orifice 113 whereby not only is enhanced volume flow or through-put of hot melt adhesive material from die or valve orifice 113 achieved, but such discharge or deposit of the hot melt adhesive material is achieved at speeds acceptable in the industry and by means of a single valve module which minimizes the number of valve modules which need to be used and maintained. In addition, the valve assembly 110 of the present invention can be retrofitted upon existing hot melt adhesive material discharge or deposit equipment or apparatus so as to replace existing PRIOR ART hot melt adhesive valve assemblies such as the valve assembly 10 disclosed within FIG. 1.

It is to be further appreciated that by utilizing a ball valve member 117, the OPEN and CLOSE movements of the ball valve member 117 with respect to its valve seat 115 is also enhanced or facilitated. More particularly, hot melt adhesive material is introduced into the valve assembly 110 through means of radially extending passageway 119 and is disposed within vertically extending axial passageway 121. Accordingly, when the ball valve member 117 is OPENED and lifted from its valve seat 115 as a result of the impingement of OPEN air upon the lower or undersurface portions of upper and lower pistons 166 and 152, respectively, the ball valve member 117 is, in effect, forced upwardly through the mass of hot melt adhesive disposed within the vertically extending axial passageway 121 whereupon such hot melt adhesive material, the pressure head of which had also just previously been assisting the maintenance of the ball valve member 117 upon its valve seat 115, now effectively slips by or passes downwardly around ball valve member 117 so as to assist the OPENING movement thereof.

When the ball valve member 117 is moved in the opposite direction, that is, toward the valve seat 115 so as to achieve a CLOSE operation, as a result of CLOSE air impinging upon the upper surface portions of the pistons 152 and 166, the opposite forces and pressures effectively prevail. More particularly, as the ball valve member 117 moves downwardly through the mass of hot melt adhesive material being discharged from the die orifice 113, the hot melt adhesive material, which had previously been assisting the maintenance of the ball valve member 117 at its OPEN position, will now tend to flow upwardly with respect to ball valve member 117, and around the same, so as to in effect re-establish a pressure head which tends to assist the CLOSING of the ball valve member 117 and the retention of the same upon its valve seat 115.

Obviously, many variations and modifications of the present invention are possible in light of the above teachings. For example, while the CLOSE air passageways 176, 178 have been disclosed as separate passageways separately supplied with the CLOSE air, it is to be appreciated that the CLOSE air passageways 176,178 may be fluidically interconnected in a manner similar to that fluidically interconnecting the cylinder chambers 150,164 with respect to the supply of OPEN air thereto. It is therefore to be understood that within the scope of the appended claims, the present invention may be practiced otherwise than as specifically described herein.

What is claimed as new and desired to be protected by Letters Patent of the United States of America, is:

1. A material dispensing valve assembly, comprising:

a housing having a longitudinal axis;

a die orifice defined within a first axial end of said housing and through which a material is able to be dispensed;

first passageway means defined within said housing for conducting the material to be dispensed to said die orifice;

a valve seat operatively associated with said die orifice;

a valve member operatively associated with said valve seat for movement between OPENED and CLOSED positions with respect to said valve seat;

a piston rod for supporting said valve member upon a first axial end portion thereof;

first and second cylinder chambers defined within axially central and second axial end portions of said housing;

first and second pistons mounted upon axially central and second axial end portions of said piston rod and respectively disposed within said first and second cylinder chambers so as to define with said piston rod and said first and second cylinder chambers a dual-piston multiplier assembly;

a first OPEN air passageway defined within said housing for transmitting OPEN air into said first cylinder chamber for acting upon a first surface portion of said first piston, and a second OPEN air passageway defined within said housing and disposed externally of said piston rod for transmitting OPEN air from said first cylinder chamber into said second cylinder chamber for acting upon a first surface portion of said second piston in order to simultaneously move said first and second pistons in a first direction so as to lift said valve member from said valve seat and OPEN said valve assembly so as to permit dispensing of the material from said die orifice; and CLOSE air passageway means defined within said housing for transmitting CLOSE air to second surface portions of said first and second pistons in order to simultaneously move said first and second pistons in a second direction so as to move said valve member toward said valve seat and CLOSE said valve assembly so as to terminate dispensing of the material from said die orifice.

2. The valve assembly as set forth in claim 1, wherein said housing comprises:

a lower module body within which said die orifice is disposed;

an axially central middle-air cylinder disposed axially atop said lower module body and within which said first cylinder chamber is disposed; and an upper-air cylinder disposed axially atop said middle-air cylinder and within which said second cylinder chamber is disposed.

3. The valve assembly as set forth in claim 2, wherein said OPEN air passageway means comprises:

a first OPEN air passageway defined within said lower module body and fludically connected to said first cylinder chamber defined within said middle-air cylinder; and a second OPEN air passageway defined within said middle-air cylinder and fluidically connecting said first cylinder chamber defined within said middle-air cylinder to said second cylinder chamber defined within said upper-air cylinder such that OPEN air can simultaneously impinge upon said first surface portions of said first and second pistons.

4. The valve assembly as set forth in claim 2, wherein said CLOSE air passageway means comprises:

a first CLOSE air passageway defined within said middle-air cylinder and fluidically connected to said first cylinder chamber defined within said middle-air cylinder; and a second CLOSE air passageway defined within said upper-air cylinder and fluidically connected to said second cylinder chamber defined within said upper-air cylinder.

5. The valve assembly as set forth in claim 1, wherein:

said valve member comprises a ball valve member.

6. The valve assembly as set forth in claim 5, wherein:

said valve seat has a substantially arcuate, hemispherical configuration for accommodating said ball valve member.

7. The valve assembly as set forth in claim 1, wherein:

said first and second pistons are internally threaded so as to be threadedly mounted upon said axially central and second axial end portions of said piston rod.

8. The valve assembly as set forth in claim 1, wherein:

said piston rod comprises first and second piston rods coaxially connected to each other.

9. The valve assembly as set forth in claim 8, wherein:

said first and second pistons are internally threaded so as to be respectively threadedly mounted upon said first and second piston rods.

10. The valve assembly as set forth in claim 2, further comprising:

spring means operatively mounted within said upper-air cylinder and engaged with said second piston disposed within said second cylinder chamber for biasing said valve member, through means of said dual-piston multiplier assembly, toward said valve seat.

11. A material dispensing valve assembly, comprising:

a housing having a longitudinal axis;

a die orifice defined within a first axial end of said housing and through which a material is able to be dispensed;

first passageway means defined within said housing for conducting the material to be dispensed to said die orifice;

a valve seat operatively associated with said die orifice;

a valve member operatively associated with said valve seat for movement between OPENED and CLOSED positions with respect to said valve seat;

a piston rod for supporting said valve member upon a first axial end portion thereof;

first and second cylinder chambers defined within axially central and second axial end portions of said housing;

first and second pistons mounted upon axially central and second axial end portions of said piston rod and respectively disposed within said first and second cylinder chambers so as to define with said piston rod and said first and second cylinder chambers a dual-piston multiplier assembly;

a first OPEN air passageway defined within said housing for transmitting OPEN air into said first cylinder chamber for acting upon a first undersurface portion of said first piston, and a second OPEN air passageway defined within said housing and disposed externally of said piston rod for transmitting OPEN air from said first cylinder chamber into said second cylinder chamber for acting upon a first undersurface portion of said second piston in order to simultaneously move said first and second pistons in a first vertically upward direction so as to lift said valve member from said valve seat and OPEN said valve assembly so as to permit dispensing of the material from said die orifice; and CLOSE air passageway means defined within said housing for transmitting CLOSE air to second upper surface portions of said first and second pistons in order to simultaneously move said first and second pistons in a second vertically downward direction so as to move said valve member toward said valve seat and CLOSE said valve assembly so as to terminate dispensing of the material from said die orifice.

12. The valve assembly as set forth in claim 11, wherein said housing comprises:

a lower module body within which said die orifice is disposed;

an axially central middle-air cylinder disposed axially atop said lower module body and within which said first cylinder chamber is disposed; and an upper-air cylinder disposed axially atop said middle-air cylinder and within which said second cylinder chamber is disposed.

13. The valve assembly as set forth in claim 12, wherein said OPEN air passageway means comprises:

a first OPEN air passageway defined within said lower module body and fludically connected to said first cylinder chamber defined within said middle-air cylinder; and a second OPEN air passageway defined within said middle-air cylinder and fluidically connecting said first cylinder chamber defined within said middle-air cylinder to said second cylinder chamber defined within said upper-air cylinder, whereby OPEN air can simultaneously impinge upon said first undersurface portions of said first and second pistons.

14. The valve assembly as set forth in claim 12, wherein said CLOSE air passageway means comprises:

a first CLOSE air passageway defined within said middle-air cylinder and fluidically connected to said first cylinder chamber defined within said middle-air cylinder; and a second CLOSE air passageway defined within said upper-air cylinder and fluidically connected to said second cylinder chamber defined within said upper-air cylinder.

15. The valve assembly as set forth in claim 11, wherein:

said valve member comprises a ball valve member.

16. The valve assembly as set forth in claim 15, wherein:

said valve seat has a substantially arcuate, hemispherical configuration for accommodating said ball valve member.

17. The valve assembly as set forth in claim 11, wherein:

said first and second pistons are internally threaded so as to be threadedly mounted upon said axially central and second axial end portions of said piston rod.

18. The valve assembly as set forth in claim 11, wherein:

said piston rod comprises first and second piston rods coaxially connected to each other.

19. The valve assembly as set forth in claim 18, wherein:

said first and second pistons are internally threaded so as to be respectively threadedly mounted upon said first and second piston rods.

20. The valve assembly as set forth in claim 12, further comprising:

spring means operatively mounted within said upper-air cylinder and engaged with said second piston disposed within said second cylinder chamber for biasing said valve member, through means of said dual-piston multiplier assembly, toward said valve seat.

* * * * *